US008424439B2

(12) United States Patent
Bailey

(10) Patent No.: US 8,424,439 B2
(45) Date of Patent: Apr. 23, 2013

(54) SYSTEMS AND METHODS FOR LAUNCHING MUNITIONS

(75) Inventor: Robert A. Bailey, Avon, IN (US)

(73) Assignee: Raytheon Company, Waltham, MA (US)

( * ) Notice: Subject to any disclaimer, the term of this patent is extended or adjusted under 35 U.S.C. 154(b) by 45 days.

(21) Appl. No.: 12/875,777

(22) Filed: Sep. 3, 2010

(65) Prior Publication Data

US 2012/0055323 A1 Mar. 8, 2012

(51) Int. Cl.
*F41F 3/04* (2006.01)

(52) U.S. Cl.
USPC ..... 89/1.816

(58) Field of Classification Search ..... 89/1.8, 89/1.81, 1.816, 1.817, 1.818; 206/3
See application file for complete search history.

(56) References Cited

U.S. PATENT DOCUMENTS

| | | | | | |
|---|---|---|---|---|---|
| 2,398,871 | A | * | 4/1946 | Buchal et al. | 89/1.815 |
| 2,844,073 | A | * | 7/1958 | Re et al. | 89/1.807 |
| 3,342,104 | A | * | 9/1967 | Robert | 89/1.817 |
| 3,412,640 | A | * | 11/1968 | Nash | 89/1.806 |
| 4,635,527 | A | * | 1/1987 | Carrier et al. | 89/1.816 |
| 5,058,481 | A | * | 10/1991 | Drummond et al. | 89/1.816 |

* cited by examiner

*Primary Examiner* — Gabriel Klein
(74) *Attorney, Agent, or Firm* — Renner, Otto, Boisselle & Sklar, LLP

(57) ABSTRACT

Systems and methods for launching munitions are provided. In some embodiments, a launcher configured to retain a munition during transport by a vehicle may comprise a first housing, circuitry, and a second housing. The first housing may define a tube configured to hold a munition for transportation. The circuitry may provide electrical communication with a munition present within the tube. The second housing may define a tube corresponding to the tube defined by the first housing. The second housing may be configured to mount to the first housing so that the tubes defined by the first housing and the second housing combine to house and launch a munition.

4 Claims, 4 Drawing Sheets

SYSTEMS AND METHODS FOR LAUNCHING MUNITIONS

TECHNICAL FIELD

The present disclosure relates to munitions, and in particular, systems and methods for launching munitions.

BACKGROUND

Munitions such as air to ground missiles (AGM), air to air missiles (AMM), and rockets can be carried and launched from various vehicle types including aircraft vehicles (e.g., fighter jets, helicopters), land vehicles (e.g., tanks, BMPs), and/or watercraft (e.g., aircraft carrier, submarines, other surface craft). Launchers, fixed to the vehicle, may be used to secure the munitions during transportation as well as used to deploy the munitions. Conventional munition launchers include a tube for holding the munitions and electromechanical apparatus for fixing the munitions to the launcher. A release mechanism arms the munitions and releases it for launching. For example, the launcher may include power supply equipment that controls the fusing and firing of the munitions.

The next generation of munitions may include further developments in target viewing, seeking, and/or detection (e.g., smart rockets). Individual munitions with target viewing, seeking, and/or detection features may require improvements in launcher technology, including changes in the tube structure, electromechanical apparatus for fixing the munitions to the launcher, and/or the release mechanism. In other applications, munitions and their respective launchers may be used without an associated vehicle, instead being adapted for transportation by an individual and/or alternative forms of transportation.

SUMMARY

The present disclosure provides techniques for launching munitions that substantially eliminates or reduces at least some of the disadvantages and problems associated with previous methods and systems.

In one embodiment, a launcher configured to retain a munition during transport by a vehicle is provided. The launcher may comprise a first housing, circuitry, and a second housing. The first housing may define a tube configured to hold a munition for transportation. The circuitry may provide electrical communication with a munition present within the tube. The second housing may define a tube corresponding to the tube defined by the first housing. The second housing may be configured to mount to the first housing so that the tubes defined by the first housing and the second housing combine to house and launch a munition.

In other embodiments, a system for launching munitions from a vehicle is provided. The system may comprise a first housing, couplings, and a second housing. The first housing may define a tube configured to hold a munition for transportation. The munition may have a length longer than a length of the tube of the first housing. The couplings may provide mechanical connection between the vehicle and the housing and electrical connectivity between the vehicle and the housing. The couplings may be configured to route electrical signals from the vehicle to the first housing. The second housing may define a tube corresponding to the tube defined by the first housing. The second housing may be configured to mount to the first housing at a junction so that the tubes defined by the first housing and the second housing combine to house and launch a munition. The second housing may be removable from the first housing without decoupling the first housing from the vehicle so that a user may access the munition at a point on its length corresponding to the length of the first housing.

In some embodiments, a method for accessing a munition housed in a launcher coupled to a vehicle is provided. The method may include removing a second housing of the launcher from a first housing, exposing a portion of the munition protruding from the first housing, accessing the exposed portion of the munition, replacing the second housing of the launcher, and covering the exposed portion of the munition for transport. The second housing may be removed from the first housing without decoupling the first housing from the vehicle.

The systems and methods of the present disclosure may provide an improved system for launching munitions capable of target viewing, seeking, and/or detection (e.g., smart rockets). For example, in contrast to known systems, the teachings of the present disclosure may protect sensors associated with a guidance and control unit housed in the nose of a munition. In known systems, the nose of a munition may be exposed to the exhaust plume of a neighboring munition once launched. The systems and methods of the present disclosure may provide improved performance and/or reliability of munitions, including associated electronic circuitry, sensors, and/or guidance and control functions. Other technical advantages will be readily apparent to one skilled in the art from the following figures, descriptions, and claims. Moreover, while specific advantages have been enumerated above, various embodiments may include all, some or none of the enumerated advantages.

BRIEF DESCRIPTION OF THE DRAWINGS

A more complete understanding of the present embodiments and advantages thereof may be acquired by referring to the following description taken in conjunction with the accompanying drawings, in which like reference numbers indicate like features, and wherein.

DETAILED DESCRIPTION

Preferred embodiments and their advantages are best understood by reference to FIGS. 1 through 5, wherein like numbers are used to indicate like and corresponding parts.

Figure 1A:
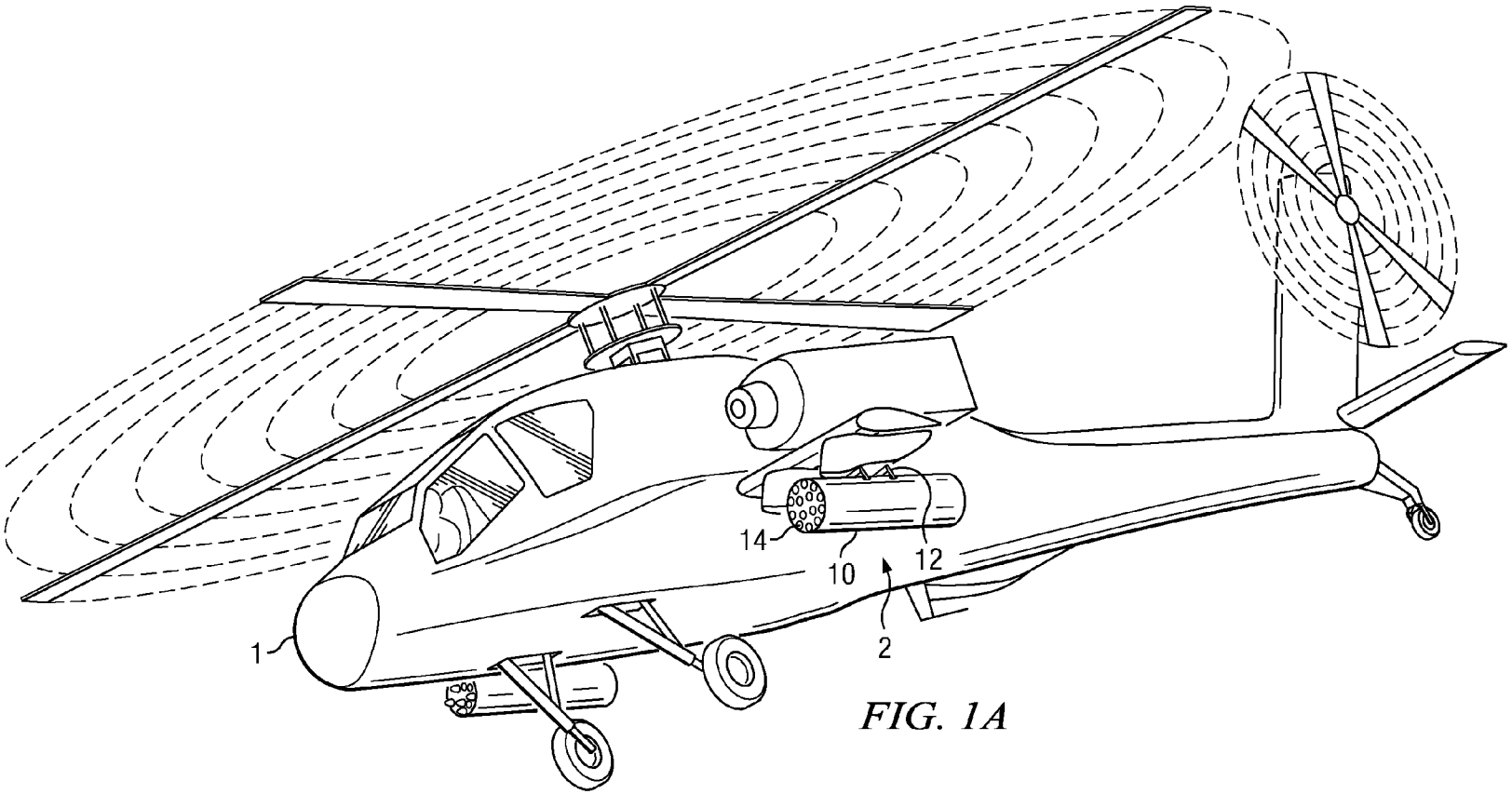
FIG. 1A illustrates an aircraft vehicle with an example launcher transporting munitions, in accordance the teachings of the present disclosure.

FIG. 1A illustrates an example vehicle 1 that includes an example launcher 2, in accordance with teachings of the present disclosure. Vehicle 1 may be an aircraft vehicle such as a helicopter, an unmanned aerial system (UAS), fighter jets (e.g., F-16, F/A-18, etc.) and/or other aircraft vehicles configured to transport and launch munitions. While FIG. 1 illustrates an aircraft vehicle, other vehicles are also contemplated. For example, vehicle 1 may be a land vehicle (e.g., tankers, transporter erector launchers, and/or military vehicles), a watercraft vehicle (e.g., submarines, surface ships, etc.) or other suitable vehicle.

Launcher 2 coupled to vehicle 1 may be configured to house munitions 20 (see FIG. 2) during transport. In some embodiments, launcher 2 may include electrical contacts through couplings 12 providing electrical communication between each of munitions 20 and a user (e.g., pilot of vehicle 1, mission control in communication with vehicle 1, etc.). In some embodiments, during deployment of vehicle 1, a user (e.g., a pilot of vehicle 1 or mission control remotely located from vehicle 1 and in communication with vehicle 1) may launch munitions 20 by communicating with munitions 20 via the electrical communication provided by launcher 2. The communication may include signals defining the coordinate information of a specific target and/or other information that allows munitions 20 to accurately strike the target, reducing or substantially eliminating incidental or collateral damage.

Figure 1B:
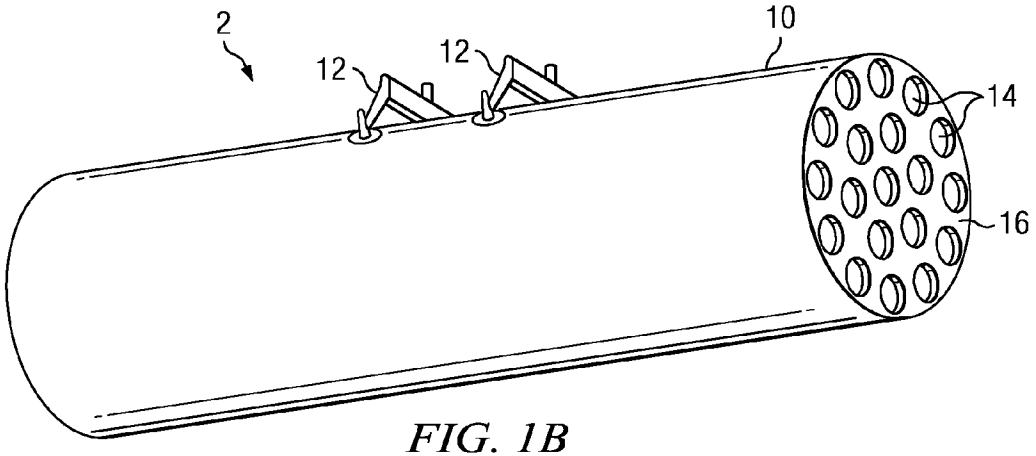
FIG. 1B illustrates the launcher of FIG. 1A, in accordance with the teachings of the present disclosure.

FIG. 1B illustrates launcher 2 of FIG. 1A in more detail. In some embodiments, launcher 2 may include housing 10, couplings 12, and tubes 14. Launcher 2 may be configured to secure munitions 20 during transportation (e.g., during flight and/or ground travel) and provide continuous electrical communication to munitions 20 until time of launch, in accordance with certain embodiments of the present disclosure. Launcher 2 may be configured to house munitions 20 in tubes 14. Launcher 2 may also include optional housing 10 configured to enclose various electrical components that couple with munitions 20 as well as munitions 20. It is noted that launcher 2 shown in FIG. 1B is an example. Other suitable types of apparatuses or system configured to launch a munition will be understood by persons having ordinary skill in the art.

Housing 10 may include any device, component, and/or features of launcher 2 configured to enclose various components of launcher 2 and couple to vehicle 1. Housing 10 may be integrally formed as a part of launcher 2 or may be secured to launcher 2. In some embodiments, housing 10 may enclose one or more electrical components disposed therein and may route the appropriate electrical components to each munition 20 in housing 10.

Housing 10 may include one or more electrical transmission wires or cables and/or any other transmission component configured to provide a communication channel between a user (e.g., a pilot or mission control in communication with vehicle 1) and munition 20. In some embodiments, electrical components of housing 10 may transmit signals sent from a user to one or more munitions 20, where the signals provide details about a launching including, for example, GPS coordinates of a target, launch time, etc.

Couplings 12 may include any component, device, and/or feature of launcher 2 and/or housing 10 configured to attach launcher 2 to vehicle 1. Couplings 12 may include electrical connections between vehicle 1 and launcher 2 and/or munitions 20. For example, in some embodiments, couplings 12 may include both mechanical attachment points and electrical connectors. Couplings 12 may be configured to mate with matching and/or corresponding features of vehicle 1, depending on the type of vehicle 1 in use.

Couplings 12 may include one or more conductors that provide electrical communication between vehicle 1 and munition 20. Couplings 12 may include electrical adaptor or interface configured to connect electrical components of vehicle 1 to launcher 2. In some embodiments, couplings 12 may include small computer system interface (SCSI), male or female electrical connectors, and/or other adaptors and/or interfaces.

Tubes 14 may include any component, device, and/or feature of launcher 2 and/or housing 10 configured for use with munitions 20. For example, tubes 14 may provide a housing for individual munitions 20, including protection from physical impact, contact, and/or contamination during storage, transport, and/or launching of neighboring munitions 20. Tubes 14 may be arranged within launcher 2 and/or housing 10 in various stacking patterns. As shown in FIGS. 1A and 1B, in the example embodiment, housing 10 provides 19 tubes 14 for munitions 20.

Figure 2:
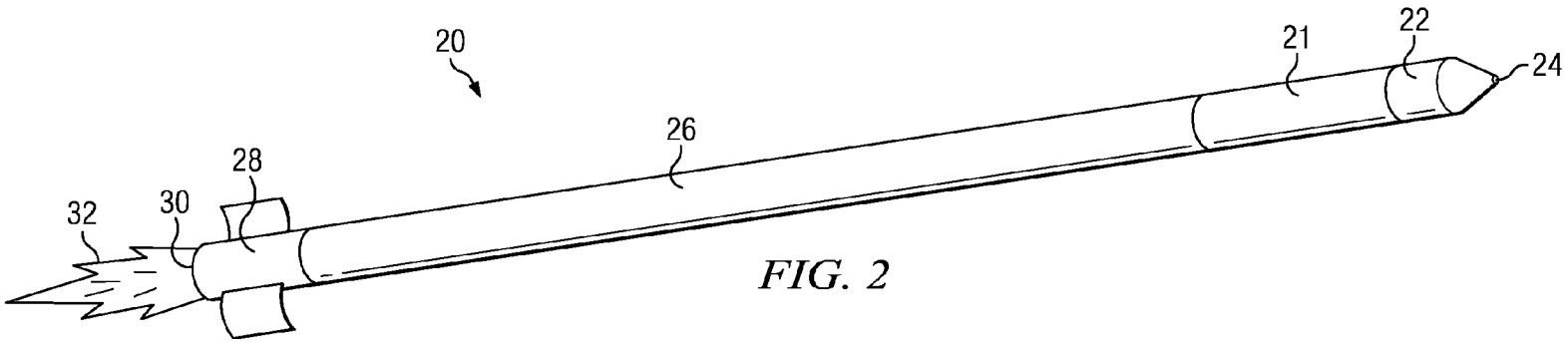
FIG. 2 illustrates an example munition that may be launched in accordance with the teachings of the present disclosure.

FIG. 2 illustrates an example munition 20, in accordance with the teachings of the present disclosure. Munition 20 may be a precision-guided munition (PGs), smart bomb, smart weapon, guided bomb unit (GBU), guided missile (e.g., laser guided missile, infrared guided missile, etc.), smart rocket, and/or other weapon that may include electronics. Munition 20, as directed by commands sent via electrical components by the pilot or mission control in communication with vehicle 1, may be configured to precisely hit a specific target with greater reliability and/or accuracy which may, in turn, reduce collateral damage.

Munition 20 may include a payload 21, a nose 22, a body 26, and a propulsion unit 28. Although one particular embodiment is shown in FIG. 2, persons having ordinary skill in the art will be able to apply the teachings of the present disclosure to a variety of munitions as described above.

Payload 21 may include any feature, device, and/or component of munition 20 configured to increase the damage to a target upon impact of munition 20. In some embodiments, payload 21 may include an explosive material and a detonator (e.g., a warhead). For example, payload 21 may include gunpowder, high explosives, and/or other conventional explosives. In other examples, payload 21 may include chemical, biologic, and/or nuclear warheads.

In some embodiments of munition 20, nose 22 may house electronic components (e.g., sensors) configured to view, search for, and/or detect targets as part of a guidance and control (G&C) unit of munition 20. For example, G&C may include a signal processing unit, a global positioning system (GPS), an inertial measurement units (IMUs) configured to provide needed inertial guidance to the munitions, imaging system, and/or other components. One or more of the components of the G&C unit of munition 20 may be used to precisely guide munition 20 during launch and/or after launch. In other embodiments, the G&C unit may be used to track, view, and/or identify potential targets for munition 20 prior to launch.

Nose 22 may include one or more sensitive electronics components subject to compromised performance when dirty, obscured, and/or impacted. In some embodiments, nose 22 may include a leading surface 24. Leading surface 24 may include different materials than the rest of nose 22, those materials selected to be transparent to one or more sensors in nose 22. For example, leading surface 24 may be transparent to infrared sensors, thermal sensors, visible light, etc.

Body 26 may include any component, device, and/or feature of munition 20 configured to provide structure and/or housing for the various components, including a G&C unit, nose 22, and/or propulsion unit 28. In some embodiments, munition 20 may have a roughly cylindrical shape. For example, body 26 may include a metal cylinder housing propellant for use by propulsion unit 28, electrical conductors for communication between a G&C unit and various components of launcher 2 and/or vehicle 1.

Propulsion unit 28 may include any component, device, and/or feature of munition 20 configured to provide thrust to munition 20 for launching. For example, propulsion unit 28 may include a jet engine, a rocket, and/or other forms of propulsion (e.g., chemical rockets, solid-propellant rockets, liquid-propellant rockets, hybrid rockets, and/or thermal rockets). Some embodiments may include a chemical rocket generating thrust by the combustion of rocket propellant. Some embodiments may generate thrust by expelling propellants that exit propulsion unit 28 at great velocity. The exit of propellant from propulsion unit 28 through exhaust 30 may create an exhaust plume 32. Exhaust plume 32 may include flame, combustion products, noise, unburned propellant, etc.

Figure 3:
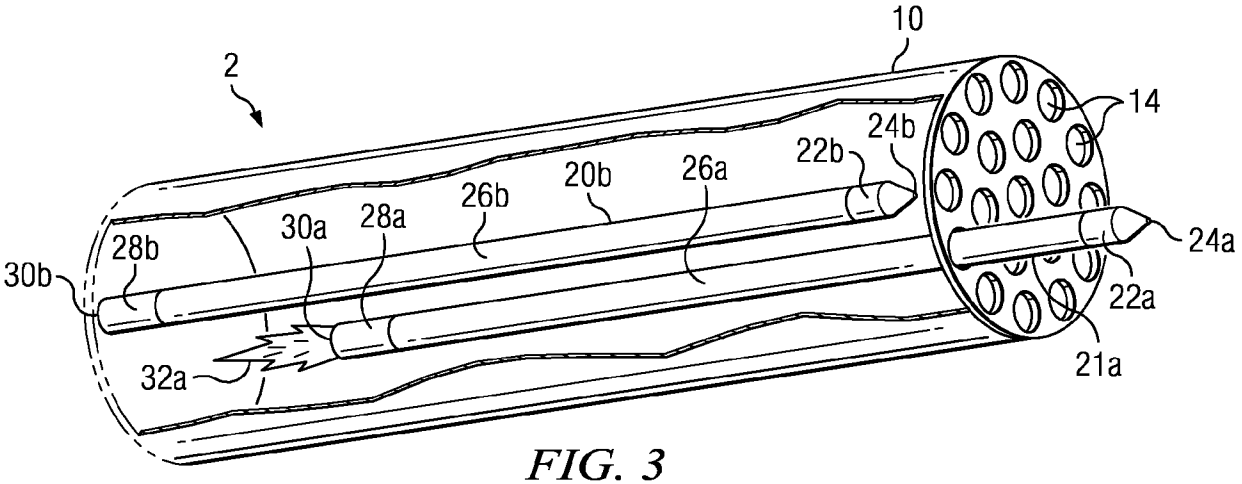
FIG. 3 shows the launcher of FIG. 1A during the launch of a munition, in accordance with one embodiment of the present disclosure.

Referring to FIG. 3, a view of launcher 2 and munitions 20*a* and 20*b* is shown, with portions of housing 10 removed, in accordance with certain embodiments of the present disclosure. Munition 20*a*, secured in launcher 2, and specifically in tube 14 of launcher 2, may be in continuous contact with vehicle 1 and/or mission control in contact with vehicle 1. The electrical signals communicated between vehicle 1 and munition 20*a* may include, for example, GPS coordinates of a target, launch time, and/or other mission-specific information regarding the intended target.

At time of launch, after appropriate signals and/or other information are sent to munition 20, launcher 2 may launch munition 20. As shown in FIG. 3, munition 20*a* may exit tube 14 of launcher 2. Launching munition 20*a* may include igniting propellant in propulsion unit 28*a* and generating exhaust plume 32*a*. During the launch of munition 20*a*, various components of a G&C unit in nose 22*a* may gather information and/or data through leading surface 24*a* of nose 22*a*. As leading surface 24*a* of nose 22*a* always remains ahead of exhaust plume 32*a*, the materials and/or energy of exhaust plume 32*a* is unlikely to impinge on leading surface 24*a* of nose 22*a* of munition 20*a*.

In contrast, however, the leading surface 24*b* of munition 20*b* may be exposed to exhaust plume 32*a* as munition 20*a* exits housing 10 of launcher 2. Exhaust plume 32*a* may deposit dirt, film, unspent propellant, combustion products, and/or heat on leading surface 24*b* of nose 22*b* of munition 20*b*, as well as any other munitions 20. The contents and/or force of the propellant exiting exhaust 30*a* may detrimentally impact the performance and/or operation of munition 20*b* and/or other remaining munitions 20.

Figure 4:
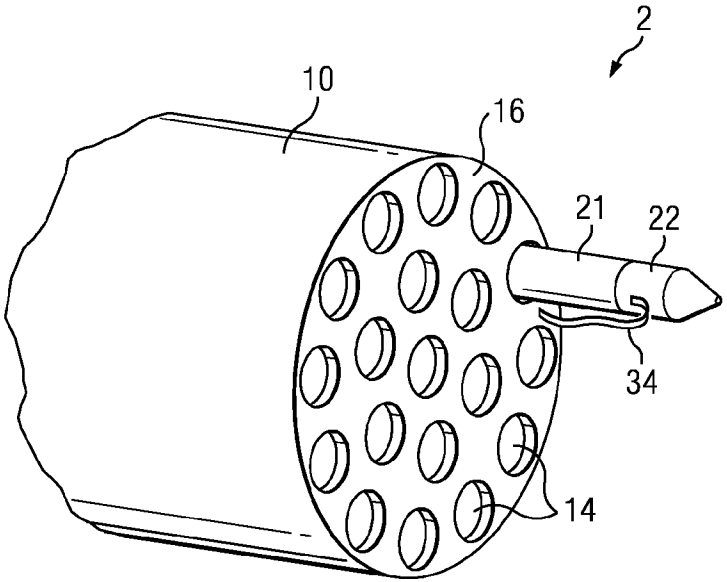
FIG. 4 illustrates an example launcher incorporating the teachings of the present disclosure.

FIG. 4 illustrates an example launcher 2 shown with the nose 22 of a munition 20 protruding from housing 10. In the embodiment shown, launcher 2 may include an electrical connection 34 between housing 10 and nose 22 of munition 20. In embodiments with a unitary housing 10 and continuous launch tubes 14, electrical connection 34 may be connected to munition 20 only at the launching face 16 of housing 10 or at the exhaust face. Electrical connection 34 may be restricted to either the nose 22 or the exhaust 30 of munition 20. Both locations may be subject to fouling, debris, and/or impact during transportation, including but not limited to exposure to exhaust plume 32 resulting from the launch of munition 20. In some embodiments of munition 20 (e.g., a smart rocket), additional electrical and mechanical connections between munition 20 and tube 14 and/or housing 10 may be disposed at various locations along the length of munition 20.

As discussed in detail above, nose 22 may house electronic components (e.g., sensors) configured to view, search for, and/or detect targets as part of a guidance and control (G&C) unit of munition 20. For example, G&C may include a signal processing unit, a global positioning system (GPS), an inertial measurement units (IMUs) configured to provide needed inertial guidance to the munitions, imaging system, and/or other components.

In some embodiments, the G&C unit of munition 20 may receive data from a control unit, through electrical connection 34. The data sent through electrical connection 34 may include updates to target information and/or may include control data sent by a pilot of vehicle 1, a munitions operator, a remote firing control operator, and/or some other user. In some embodiments, particular software and/or hardware associated with a G&C unit may receive software and/or firmware update related to the operation of processing units and/or other electronic components.

Figure 5:
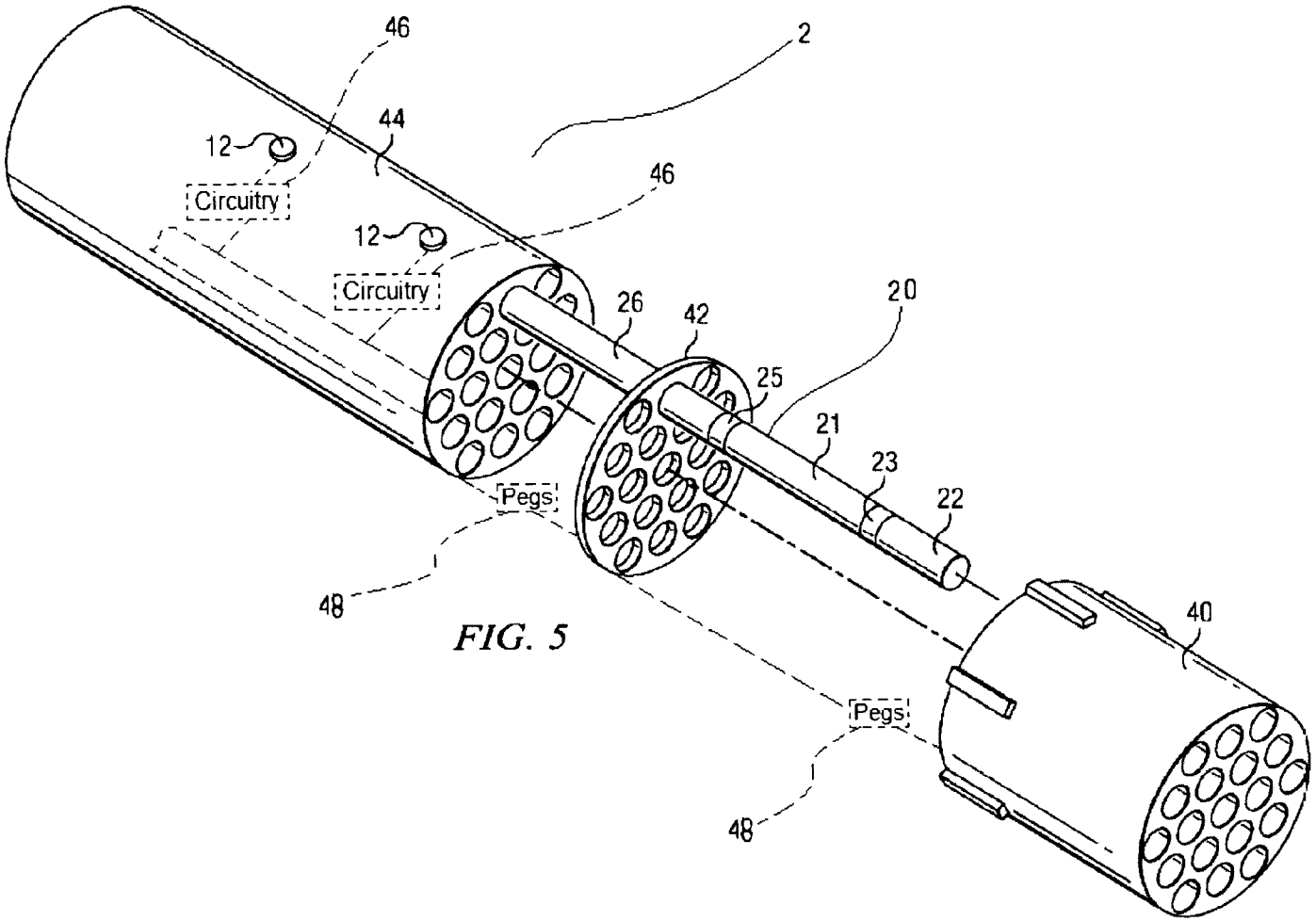
FIG. 5 illustrates an example launcher incorporating the teachings of the present disclosure.

FIG. 5 illustrates an example embodiment of launcher 2 that provides access to various positions along the length of munition 20 for various interfaces (e.g., mechanical and/or electrical connections). In such embodiments, munition 20 may include multiple interfaces 23 and 25. Interfaces 23 and 25 may include electrical connections for data transmission, mechanical detents, and/or other connections between launcher 2 and munition 20. Launcher 2 may include a housing with various sections separable from one another. For example, in the embodiment shown in FIG. 5, launcher 2 includes three separate parts: a forward housing 40, an intermediate housing 42, and an aft housing 44. Aft housing 44 may be attached to a vehicle 1 (not expressly shown in FIG. 5) by couplings 12. The couplings 12 may include electrical connections such as circuitry 46, between vehicle 1 and launcher 2 and/or munitions 20. Aft housing 44 may include continuous tubes that run the length of aft housing 44 for transportation and mounting of munitions 20.

Forward housing 40 and intermediate housing 42 may be configured to attach to aft housing 44 without coupling directly to vehicle 1. The various sections of the housing of launcher 2 may be connected by any appropriate devices, components, and/or features of launcher 2. For example, all three sections may include a flange that can be bolted by an operator. In another example, aft section 44 and/or forward section 40 may include pegs 48 that protrude through intermediate section 42 to support intermediate section 42. The connection may provide access to an operator and/or maintenance of the various connections 23 and 25 of munition 20. Even after launcher 2 is fixed to vehicle 1, an operator may remove one or more sections of the housing (e.g., forward housing 40) and perform maintenance, installation, inspection, and/or cleaning of the various connections 23 and 25, and/or complete manual electrical connections between launcher 2 and munition 20.

Embodiments of a launcher including a housing comprising multiple sections may provide an effectively continuous tube and access to various points along the length of munition 20 at the same time. Although the figures and embodiments disclosed herein have been described with respect to information handling systems, it should be understood that various changes, substitutions and alternations can be made herein without departing from the spirit and scope of the disclosure as illustrated by the following claims.

What is claimed:

1. A system for launching munitions from a vehicle, the system comprising:

a first housing defining a first tube configured to hold a munition for transportation, the munition having a length longer than a length of the first tube of the first housing;

couplings providing mechanical connection between the vehicle and the first housing and electrical connectivity between the vehicle and the first housing;

the couplings configured to route electrical signals from the vehicle to the first housing;

a second housing defining a second tube corresponding to the first tube defined by the first housing;

the second housing configured to mount to the first housing at a junction so that the tubes defined by the first housing and the second housing combine to house and launch a munition;

the second housing removable from the first housing without decoupling the first housing from the vehicle so that a user may access the munition at a point on a portion of its length corresponding to at least a length of the second housing;

a third housing defining a third tube corresponding to the tubes defined by the first housing and the second housing, the third housing configured to mount to the second housing so that the tubes defined by the first housing, the second housing, and the third housing combine to hold a munition;

wherein the first housing is an aft housing;

wherein the third housing is a forward housing; and wherein the second housing is an intermediate housing between the forward housing and the aft housing.

2. A system according to claim 1, wherein the first housing has a length greater than a combined length of the second housing and the third housing.

3. A system according to claim 2, wherein the third housing has a length greater than the length of the second housing.

4. A system according to claim 1, wherein either the first housing or the second housing includes pegs that protrude through the third housing, to support the third housing.

* * * * *